US005829488A

United States Patent [19]

Fagerholm et al.

[11] Patent Number: 5,829,488

[45] Date of Patent: Nov. 3, 1998

[54] DRYER FABRIC WITH HYDROPHILLIC PAPER CONTACTING SURFACE

[75] Inventors: Lars Fagerholm, Vanda, Finland; William A. Luciano, Saratoga Springs, N.Y.

[73] Assignee: Albany International Corp., Albany, N.Y.

[21] Appl. No.: 657,089

[22] Filed: Jun. 3, 1996

[30] Foreign Application Priority Data

Sep. 8, 1995 [SE] Sweden ..... 9503114

[51] Int. Cl.[6] ..... D21F 1/10; D21F 7/08; D21F 5/00

[52] U.S. Cl. ..... 139/383 A; 427/412; 162/902; 442/118

[58] Field of Search ..... 428/225, 236; 139/383 A; 427/412; 162/902; 442/118

[56] References Cited

U.S. PATENT DOCUMENTS

| | | | |
|---|---|---|---|
| 3,573,089 | 3/1971 | Tate et al. | 139/425 A |
| 4,290,209 | 9/1981 | Buchanan et al. | 139/383 A |
| 4,976,821 | 12/1990 | Laapotti . | |
| 5,169,711 | 12/1992 | Bhatt et al. | 428/257 |
| 5,506,033 | 4/1996 | Smith | 428/192 |

FOREIGN PATENT DOCUMENTS

| | | | |
|---|---|---|---|
| 0 367 738 | 5/1990 | European Pat. Off. | 139/383 A |
| 6-41895 | 2/1994 | Japan | 139/383 A |

OTHER PUBLICATIONS

PCT International Search Report No. SE 95/00862 dated ——May 8, 1996.

*Primary Examiner*—Andy Falik
*Attorney, Agent, or Firm*—Kane, Dalsimer, Sullivan et al.

[57] ABSTRACT

A dryer fabric for use in a dryer section having a closed transfer in a papermaking machine. The dryer fabric has a structure of woven threads with one side, called the paper side, being adapted to support and abut against a paper web in the dryer section. At least some of the threads contacting against the paper web are hydrophilic, thereby providing for adhesion between the dryer fabric and the paper web.

13 Claims, 1 Drawing Sheet

DRYER FABRIC WITH HYDROPHILLIC PAPER CONTACTING SURFACE

FIELD OF THE INVENTION

The present invention relates to a dryer fabric for use in the dryer section of a papermaking machine. More specifically, the invention is directed to providing an improved dryer fabric for a dryer section having a closed transfer for the purpose of achieving, in the dryer section, a good transport of the web and good runnability at high web speeds and avoiding shrinkage of the paper web, especially shrinkage in the cross direction.

BACKGROUND OF INVENTION

In conventional cylinder dryer sections with upper and lower cylinders and separate upper and lower dryer fabrics, the paper web runs between the cylinders in so-called free draws in which the web has no contact with any dryer fabric. The problems of web fluttering and web breaks in such dryer sections of high-speed papermaking machines have been noticed for a long time, and for this reason, various configurations of a so-called closed transfer or single-run (SR) have been developed since the end of the seventies, thereby avoiding the free draws within the drying group. The enclosed FIG. 1 shows the principle of the single-run and illustrates how a dryer fabric V constantly follows a paper web B. Since the dryer fabric will extend between the paper web B and the lower cylinder C1, the heating can be restricted to the upper cylinders C2.

Also for the single-run there are, however, a number of web running problems at high speeds, and since the development of today is directed towards increasing web speeds, it is important to obviate these problems.

A first problem (P1) is that the paper web B, at the exit of the upper cylinder, tends to follow the upper cylinder C2 instead of the dryer fabric owing to vacuum and adhesion forces between the paper web and the upper cylinder. This results in blistering as shown at "1" in the FIG. 1.

A second problem (P2) is that the web B, at the entry of the lower cylinder C1, tends to be blown off the dryer fabric, as shown at "2" in the FIG. 1, owing to the overpressure of air in the nip between the lower cylinder C1 and the dryer fabric V. This released state of the web can optionally be spread up to the exit of the lower cylinder. When increasing the web speed, the dryer fabric is dragging more and more air to the lower ingoing nip, which in turn increases the web release.

A third problem (P3) is that an air film may arise at "3" between the dryer fabric V and the web B along the lower cylinder C1. This air film may, if it is not directed through the dryer fabric, cause a blister at "4".

The effect of the above-mentioned web-running problems P1–P3 is that the web release results in elongation of the web in the running direction, below called machine direction elongation (MD elongation), which in turn results in too great a web length being supplied to the next upper cylinder causing wrinkles in the cross direction.

Apart from these problems P1–P3, there is in the dryer section of a papermaking machine also the general problem (P4) of the web shrinking in its cross direction, below called cross direction shrinkage (CD shrinkage). Traditionally, it has been very difficult to prevent CD shrinkage, resulting in an uneven cross direction profile of the paper properties. Owing to this CD shrinkage, a maximum web width cannot be maintained throughout the dryer section.

In an attempt to counteract the overpressure zone at the entry of the lower cylinder (at "2" in the FIG. 1), i.e. in order to solve problem P2, it is known to use blow boxes which by ejector action produces a local negative pressure at the ingoing nip of the lower cylinder C1.

In order to solve problem P2 and thus increase the runnability, it has further been suggested that the lower cylinders should have grooves or blind drilled holes for absorbing the overpressure in the nip.

Another principle, which aims at eliminating the overpressure at the ingoing nip (P2) of the lower cylinder, is based on the introduction of suction rolls instead of plain cylinders so as to improve the run of the web at high speeds. By the web being sucked against the dryer fabric along the suction roll, this technique also contributes positively to the reduction of the problem (P4) of CD shrinkage.

These known techniques for improving the transport of the web and the runnability have, however, been found to be insufficient for the high machine speeds which are desired today.

In order to counteract CD shrinkage, it is also known to mechanically apply, through the entire drying interval or parts thereof, outwardly directed forces, which counteract shrinkage, to the lateral edges of the web, as disclosed in e.g. SE 440,518, SE 462,171 and SE 468,217. The techniques disclosed in these documents are, however, complicated to use and yield relatively uneven fastening. Moreover, unwanted waste forms if the web edges fastened in the dryer section must be cut off after the outwardly directed forces should no longer be applied.

U.S. Pat. No. 5,397,438 discloses a method for reducing cross direction shrinkage of a paper web when passing through an SR dryer section of a papermaking machine. An adhesive is continuously applied to the lateral edges of the dryer fabric supporting the web, for the purpose of producing a higher friction between the web and the dryer fabric at the edges. In the embodiment described, a glue is used as said adhesive.

It should be especially noted that, for complying with all wishes, it is not sufficient to prevent blistering between the web and dryer fabric. In order to counteract shrinkage, the web must also be prevented from sliding on the dryer fabric, especially in CD, but also in MD.

A further drying problem is that the dry content of the paper web tends to be higher at the edges of the web than in its center. To avoid this problem, dryer fabrics having a profiled air permeability have been developed, as disclosed in e.g. FI 59837 and SE 8204524-6. These dryer fabrics have been woven with different yarn density in the center and at the edges.

Regarding prior art technique, it may be noted that it is known to apply chemicals in the voids between the threads of a woven dryer fabric, with the purpose of controlling the permeability and/or the void volume and to provide a more even surface.

SUMMARY OF THE INVENTION

The present invention has been developed for the purpose of solving, or at least reducing to a considerable extent, the above-mentioned problems P1–P4 in dryer sections having a single-run in papermaking machines.

More specifically, the object of the invention is to suggest a dryer fabric which permits a good transport of the web and excellent runnability at high speeds and which counteracts shrinkage of the web, especially CD shrinkage.

These and other objects are achieved by a dryer fabric having the features stated in claim 1, preferred embodiments being defined in the dependent claims.

A dryer fabric according to the invention is thus characterize in that at least some of the thread abutment surfaces against the paper web are hydrophilic for producing adhesion between the dryer fabric and the paper web in the dryer section.

Thanks to this design of the inventive dryer fabric, the hydrophilic contact surfaces of the threads abutting against the paper web will effectively prevent the web from sliding on the dryer fabric, in CD as well as in MD, and from rising from the dryer fabric. This solves, or at least reduces to a considerable extent, all the above-mentioned problems P1–P4 by a modification of the dryer fabric, without necessitating any extensive changes in the dryer section or use of complicated edge fastening arrangements of the type described in the above-mentioned references.

It should be noted that the used term "adhesion" relates to a force arising when the dryer fabric and the web are in contact with one another, and that the hydrophilic properties of the dryer fabric thus do not per se imply that the paper side of the dryer fabric is generally adhesive in a traditional sense, i.e. adhesive to any material whatsoever. This is an important difference compared to that disclosed in the above-mentioned U.S. Pat. No. 5,397,438.

Traditional dryer fabrics are woven of threads manufactured of raw materials having hydrophobic surface properties, usually polyester, which makes the thread surfaces water-repellent, i.e. repellent to the paper web which contains a certain amount of water. A dryer fabric according to the invention will however, owing to the hydrophilic contact surfaces of the threads, so to say adhere the web to itself, which results in an excellent web transport and excellent runnability as well as reduced shrinkage. It may be noted that the adhesive force between dryer fabric and web is no problem in a dryer section having a single-run, since the web in this type of dryer section should not leave the dryer fabric between the cylinders in the drying group like in the prior art technique with separate upper and lower dryer fabrics.

It should also be noted that the arrangement of hydrophilic contact surfaces of the threads on the paper side need not affect the mechanical surface roughness of the paper side, which may thus be completely unaffected or at least not noticeably affected by the inventive design of the dryer fabric.

The adhesion or friction properties between the dryer fabric and the paper web, which are improved according to the invention, yield improved performance in several respects:

- The web control or transport is improved in dryer sections having a closed transfer since the adhesion keeps the web on the dryer fabric and thus counteracts blistering, thereby making it possible to operate the machine at higher speeds.
- The CD shrinkage of the paper web in the dryer section is reduced since the adhesion prevents the web from moving, i.e. sliding on the dryer fabric surface.
- The tail threading, when the web is initially to be introduced into the dryer section, is facilitated. In tail threading, the width of that end of the web which is to be introduced into the dryer section is reduced, and if the corresponding surface area portion of the dryer fabric, for instance a side edge portion, has hydrophilic contact surfaces of the threads, the attachment of the web to the dryer fabric is facilitated owing to the adhesion.
- In closed transfer positions, for instance between the press section of the papermaking machine and the subsequent dryer section, or between neighbouring drying groups of the dryer section, the invention can improve web control and web pick-up. Unwanted MD elongation and, resulting therefrom, CD shrinkage of the web in free draws between different sections can be eliminated or at least counteracted since it is possible to let the adhesive dryer fabric run closer to the exit of the preceding section and there "adhere" to and pick up the web.

DETAILED DESCRIPTION OF THE PREFERRED EMBODIMENTS

Figure 1:
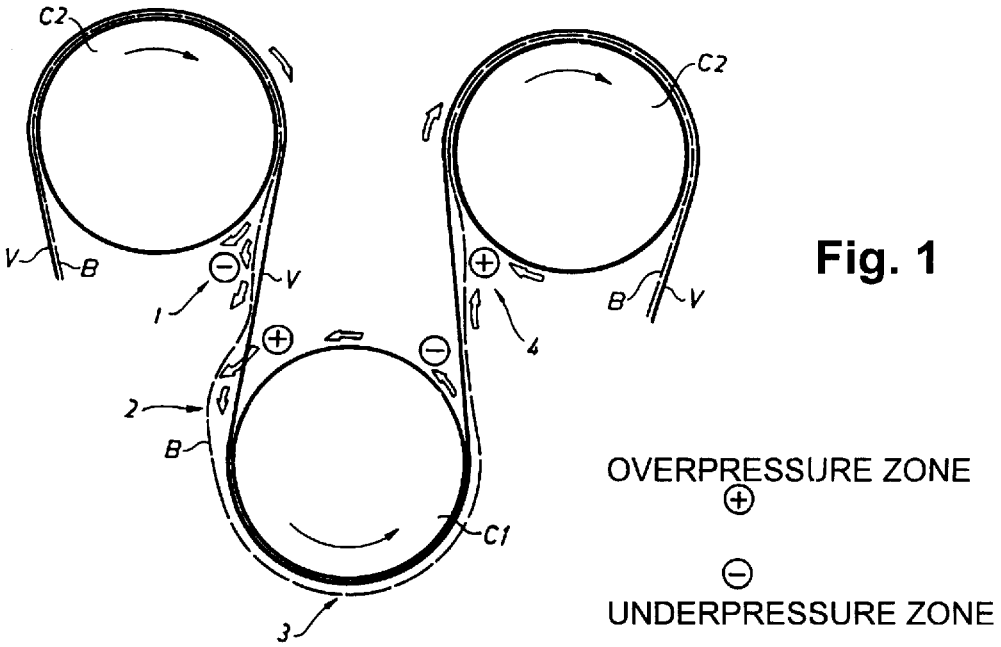
FIG. 1 shows the single run arrangement for a dryer section of papermaking machine.

There are different possibilities of preparing said hydrophilic contact surfaces of the threads. According to a first embodiment of the invention, the woven structure of the dryer fabric is provided with a hydrophilic surface coating on the paper side of the dryer fabric, i.e. the hydrophilic surface coating is applied to an already woven dryer fabric before mounting thereof in the machine, for instance as a final step in the manufacture of the dryer fabric. However, it is possible to remove the dryer fabric from the machine after a certain period of operation for re-treatment, for instance if the dryer fabric surface, due to clogging, does not comply with its hydrophilic function any longer and/or due to wear of the surface. Such a surface coating will then be found on said contact surfaces of the threads that should adhere to the web, and at the points of intersection between the weft and warp threads of the woven structure. In dependence of the choice of material for the surface coating, the latter can, in addition to the adhesive function to the web, thus also provide an increased stiffening and/or setting of the dryer fabric. On the other hand, the surface roughness of the paper side will normally not be affected.

Such a surface coating can be applied to the paper side of the dryer fabric in several different manners, for instance by spraying or by mechanical application by means of a roller which collects the surface coating material from a tank.

It is obvious that such a surface coating can be applied either as a final step in connection with the actual manufacture of the dryer fabric, or as an alternative afterwards to an existing dryer fabric before mounting thereof in the machine.

Independently of the technique used for application of the surface coating to the paper side of the dryer fabric, the surface roughness of the paper side will normally not be noticeably affected by the surface coating. The thickness of such a surface coating should thus be relatively small, and should in any case not exceed 0.1 mm. The preferred thickness range of the surface coating is 0.01–0.05 mm.

The coating of the substance at issue and subsequent cross-linking of the molecules included therein can occur after weaving either on the stock piece or on the ready-made dryer fabric (finished dryer fabric with correct dimensions, with a seam etc.). This is in contradiction to the above-mentioned U.S. Pat. No. 5,397,438, where no cross-linking of the applied glue is effected before use of the dryer fabric, since the glueing effect then would be lost.

According to the invention, such a hydrophilic surface coating can be applied to the entire paper side of the dryer fabric, or only parts thereof. According to one embodiment, the surface coating is applied as, for instance, two continuous bands along the side edge portions of the dryer fabric. It is also possible to provide a desired adhesion cross direction profile of the dryer fabric, by varying the degree of surface coating across the width of the dryer fabric and/or by using different surface coating materials on different portions of the dryer fabric, which yield varying hydrophilic properties in the cross direction of the dryer fabric, for instance a relatively high adhesion in the edge portions of the dryer fabric and a relatively low adhesion in the central portion of the dryer fabric. If the adhesion varies in the cross direction of the dryer fabric, it should of course be substantially constant in the machine direction.

According to another embodiment of the invention, said hydrophilic contact surfaces of the threads are prepared by the woven structure being woven of threads of which at least some have a hydrophilic circumferential surface before weaving. Such a hydrophilic circumferential surface of the threads can be prepared by application of a surface coating enclosing the threads. The same coating caliper can be used as in the first-mentioned surface coating embodiment. By having such "ready-made" threads, on whose skin the coating is already cross-linked before the weaving of the dryer fabric, it is already possible to design the properties of the dryer fabric in the weaving loom since the weave pattern and choice of materials determine the running of the threads at issue.

Figure 2:
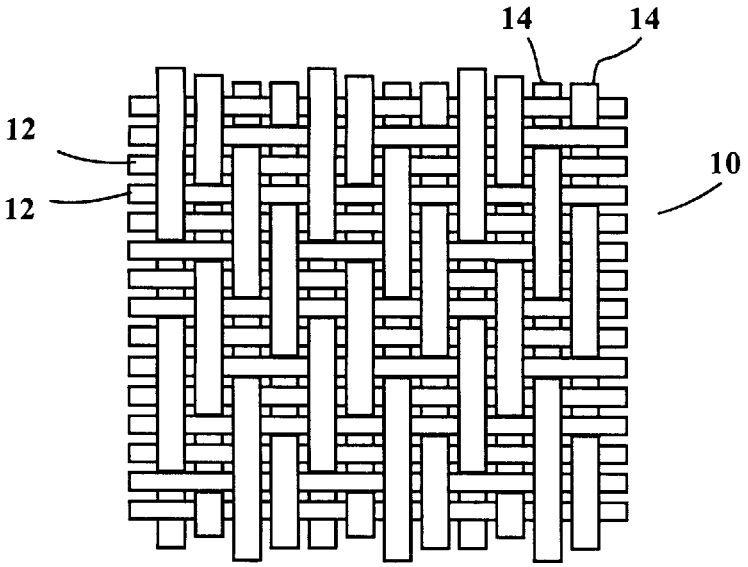
FIG. 2 shows a top view of a section of a fabric produced in accordance with this invention.
Figure 3:
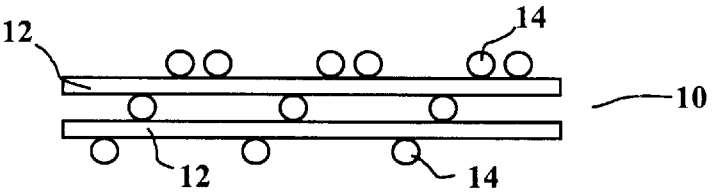
FIG. 3 shows a cross sectional view of a fabric produced in accordance with the present invention.

FIGS. 2 and 3 show a woven multilayered fabric 10 woven of cross machine direction threads 12 and threads 14. At least some of the threads 12 and 14 of the fabric 10 have a hydrophilic surface coating.

If the woven structure of the dryer fabric comprises two or more thread layers, which frequently occurs, the thread layer defining the paper side of the dryer fabric can be wholly or partly woven of such threads having a hydrophilic circumferential surface, while the underlying layer is wholly or partly woven of threads having a non-hydrophilic circumferential surface. Of course, it is also possible to weave a multilayered dryer fabric exclusively of threads having a hydrophilic skin surface.

Also if the dryer fabric is woven of initially hydrophilic threads, it is possible to prepare special cross direction profiles of the hydrophilicity by selecting varying types of threads in the cross direction of the dryer fabric and/or by varying the weave pattern. For instance, adhesion may be increased locally by weaving longer floatations of hydrophilic threads on the paper side of the dryer fabric.

According to a preferred embodiment of the invention, the hydrophilic contact surfaces have a surface energy of about 40–75 mJ/m$^2$, which can be compared with dryer fabrics woven of monofilament threads of polyester having a surface energy of about 30 mJ/m$^2$.

Table 1 below indicates an exemplary composition of an active substance for use as hydrophilic surface coating of the paper side of the dryer fabric. This substance can optionally, depending on the type of applicator and the selected application quantity, be diluted with water to be applied in thinner layers.

TABLE I

| Component | Designation | Percentage by weight |
|---|---|---|
| Water-based polyurethane emulsion | Bayhydrol 123 | 96 |
| Cross-linking agent (Melamine formaldehyde) | Resimene 7 | 3.5 |
| Catalyst (Salt of toluenesulfonic acid | BYK | 0.5 |

Practical experiments carried out with a coated dryer fabric prepared according to the above formula gave good results and confirmed the technical effect of the invention. The application of the hydrophilic material to the dryer fabric was effected by the kiss-roll technique at a relatively high speed (10 m/min), and it is desirable to apply only one thin layer at a time in order to prevent formation of droplets. After applying the required amount of the substance, the dryer fabric was allowed to dry at about 90° while being run at a relatively low speed (0.5 m/min). Finally, the dryer fabric was allowed to be cured at 150°. The dryer fabric obtained functioned in an excellent manner on a machine producing fine paper (700 m/min; 50–110 g/m$^2$). The inventive dryer fabric was installed in the 6th and 7th drying group after the coating unit at the end of the machine. In case of breaks at the Pope, which is the reel-up in which the paper web is wound onto a reel, it was easy to temporarily guide the web down into the cellar without any fluttering. By the paper web following the dryer fabric, re-threading of the entire machine was not necessary, which means that time is saved and the same quality as before the break is maintained.

Moreover, practical experiments have confirmed the technical effect of coating only the edge of the dryer fabric, which yields easier tail threading of the web as compared with a corresponding dryer fabric without any coating.

A comparative contact angle measurement and conversion into surface energy was also performed in laboratory tests, and Table II below states the result for a thread supplied by Hoechst AG (DE) without and with a coating according to the formula in Table I.

TABLE II

| Thread material | Measured surface energy (mJ/m$^2$) |
|---|---|
| Hoechst PET 910 C | 35 |
| The same thread, but coated according to the above formula | 50 |

Finally, it may be mentioned that, depending on the selected substance for preparing the hydrophilic properties of the dryer fabric, it may be convenient to let the dryer fabric run idle after installation thereof in order to carry out curing and cross-linking and removal of any solvent, if used.

We claim:

1. A dryer fabric for use in a dryer section having a closed transfer in a papermaking machine comprising a structure woven of threads, one side of the structure, called the paper side, being adapted to support and abut against a paper web in the dryer section, wherein at least some of the thread contact surfaces which are positioned on the paper side of the dryer fabric and which during usage of the fabric abut against the paper web are hydrophilic, thereby obtaining adhesion between the fabric and the paper web, and wherein the woven structure, in order to make said thread contact surfaces hydrophilic, is provided with a hydrophilic surface coating on the paper side of the dryer fabric, said surface coating including a polyurethane-based hydrophilic substance.

2. The dryer fabric as claimed in claim 1 wherein said hydrophilic surface coating is of a thickness not exceeding 0.1 mm.

3. The dryer fabric as claimed in claim 1, wherein said hydrophilic surface coating is arranged over the entire surface of the woven structure on the paper side of the dryer fabric.

4. The dryer fabric as claimed in claim 1, wherein the hydrophilic surface coating is arranged only partially over the surface of the woven structure on the paper side of the dryer fabric.

5. The dryer fabric as claimed in claim 4, wherein the hydrophilic surface coating is in the form of continuous bands along edge portions of the woven structure on the paper side of the dryer fabric.

6. The dryer fabric as claimed in claim 1, wherein said hydrophilic thread contact surfaces have a surface energy of about 40–75 $mJ/m^2$.

7. The dryer fabric as claimed in claim 1 wherein said hydrophilic thread contact surfaces have a surface energy which varies in a cross direction of the dryer fabric according to a predetermined profile.

8. A dryer fabric for use in a dryer section having a closed transfer in a papermaking machine, comprising a structure woven of threads, one side of the structure, called the paper side, being adapted to support and abut against a paper web in the dryer section, wherein at least some of the thread contact surfaces which are positioned on the paper side of the dryer fabric and which during usage of the fabric abut against the paper web are hydrophilic, thereby obtaining adhesion between the fabric and the paper web, and wherein on the paper side of the dryer fabric, the woven structure, in order to make said thread contact surfaces hydrophilic, is woven of threads of which at least some have a hydrophilic circumferential surface is formed of a hydrophilic surface coating enclosing said threads.

9. The dryer fabric as claimed in claim 8, wherein said hydrophilic surface coating is of a thickness not exceeding 0.1 mm.

10. The dryer fabric as claimed in claim 8, wherein said threads of which at least some have a hydrophilic circumferential surface are prepared from a blank having hydrophilic surface properties, in order to make said thread contact surfaces hydrophilic.

11. The dryer fabric as claimed in claim 8, wherein the woven structure comprises two or more thread layers, of which a layer defining the paper side of the dryer fabric is entirely or at least partly woven on such threads having a hydrophilic circumferential surface.

12. The dryer fabric as claimed in claim 8, wherein said hydrophilic thread contact surfaces have a surface energy of about 40–75 $mJ/m^2$.

13. The dryer fabric as claimed in claim 8, wherein said hydrophilic thread contact surfaces have a surface energy which varies in a cross direction of the dryer fabric according to a predetermined profile.

* * * * *